US006172466B1

(12) United States Patent
Ki et al.

(10) Patent No.: US 6,172,466 B1
(45) Date of Patent: Jan. 9, 2001

(54) PHASE-CONTROLLED DIMMABLE BALLAST

(75) Inventors: Wing Hung Ki, Kowloon; Kwok Tai Philip Mok, Kln; Kin On Johnny Sin, Shatin, all of (HK)

(73) Assignee: The Hong Kong University of Science and Technology (HK)

( * ) Notice: Under 35 U.S.C. 154(b), the term of this patent shall be extended for 0 days.

(21) Appl. No.: 09/249,106

(22) Filed: Feb. 12, 1999

(51) Int. Cl.[7] ..... H05B 37/02
(52) U.S. Cl. ..... 315/224; 315/307; 315/DIG. 4
(58) Field of Search ..... 315/224, 219, 315/209 R, 307, 225, DIG. 4, DIG. 7, 291, 200 R, 205, 194

(56) References Cited

U.S. PATENT DOCUMENTS

| | | | | |
|---|---|---|---|---|
| 4,350,933 | * | 9/1982 | Agarwala et al. | 315/278 |
| 4,370,600 | | 1/1983 | Zansky | 315/224 |
| 4,392,087 | | 7/1983 | Zansky | 315/219 |
| 4,441,054 | | 4/1984 | Bay | 315/219 |
| 4,492,897 | | 1/1985 | Sairanen et al. | 315/219 |
| 4,523,131 | | 6/1985 | Zansky | 315/307 |
| 4,797,599 | * | 1/1989 | Ference et al. | 315/194 |
| 5,055,742 | * | 10/1991 | Jurell et al. | 315/94 |
| 5,144,205 | * | 9/1992 | Motto et al. | 315/224 |
| 5,315,214 | | 5/1994 | Lesea | 315/209 R |
| 5,559,395 | * | 9/1996 | Venkitasubrahmanian et al. | 315/247 |
| 5,604,411 | * | 2/1997 | Venkitasubrahmanian et al. | 315/307 |
| 5,872,429 | * | 2/1999 | Xia et al. | 315/194 |
| 6,008,593 | * | 12/1999 | Ribarich | 315/307 |

* cited by examiner

*Primary Examiner*—Don Wong
*Assistant Examiner*—Tuyet T. Vo
(74) *Attorney, Agent, or Firm*—Burns, Doane, Swecker & Mathis, L.L.P.

(57) ABSTRACT

A method and apparatus are disclosed for the dimming control of a fluorescent lamp driven by an electronic ballast. A small portion (eg less than 15°) of the phase of the input supply voltage is removed, and the precise amount of the phase removed is used to generate a switching signal that controls the switching frequency of the electronic ballast and hence the light power output. The switching frequency is generated by producing pulses of a width proportional to the amount of phase removed, integrating the pulses to produce a voltage proportional to the phase removed, converting that voltage to a current that varies with a frequency depending on the voltage, and using that varying current to generate the switching frequency.

21 Claims, 5 Drawing Sheets

PHASE-CONTROLLED DIMMABLE BALLAST

FIELD OF THE INVENTION

This invention relates to an electronic ballast for a fluorescent lamp that provides dimming control of the lamp.

BACKGROUND OF THE INVENTION

Fluorescent lamps are a very popular form of illumination, especially in offices and workplaces, but also increasingly in domestic applications. However, one drawback with fluorescent lamps in comparison with incandescent lamps, is that it is much harder to provide a dimmable lamp. The main reason for this is that a certain minimum voltage must be applied to the lamp in order for the discharge that is the source of illumination to occur. If the applied voltage goes below this minimum, the discharge may not strike and the lamp will simply go out. Thus controlling the lamp's power output by simply varying the applied voltage (as is done for incandescent lamps) is generally unsuccessful.

Conventionally fluorescent lamps are driven by ballast circuits. Originally such ballast circuits were electromagnetic, but more recently electronic solid-state ballast circuits have become preferred. Such electronic ballasts are effectively switched mode power electronic circuits and have a number of advantages including improved efficiency of the overall system, higher lumen output per watt and longer lifetime of the lamps.

PRIOR ART

A number of approaches have been taken to providing dimming control for a fluorescent lamp, but to date none have been commercially successful as can be seen from the fact that dimmable fluorescent lamps are surprisingly rare given their desirability in terms of energy saving, cost saving and in the greater versatility that such a lamp would possess.

For example, U.S. Pat. No. 4,370,600, U.S. Pat. No. 4,392,087 and U.S. Pat. No. 4,441,054 all disclose fluorescent lamps in which the dimming control is accomplished either by pulse width modulation of the inverter drive, or by changing the supply AC voltage to the rectifying circuit that in turn supplies the DC voltage to the inverter. In U.S. Pat. No. 4,523,131 the dimming is achieved by changing the primary inductance of a transformer system characterized by a variable inductance primary winding. In U.S. Pat. No. 5,315,214 dimming is controlled through sensing the lamp current with a reference signal to control either pulse width or frequency of the inverter drive.

Known methods of providing dimming control of a fluorescent lamp include varying the duty cycle or the switching frequency of the two switches that generally comprise the inverter drive of a conventional electronic ballast. Higher switching frequency leads to lower light power output. Conventionally, however, to achieve this control it is necessary to provide a separate controller with a pair of control wires leading to the ballast separate from the input power supply wires. This means that for a fluorescent lamp provided with such a dimming control four wires are required—two to carry input power, and two to control dimming—and this is clearly undesirable for a number of reasons including cost and the general inconvenience of requiring separate switches to control the power on/off and the dimming of the lamp.

U.S. Pat. No. 4,492,897 shows a method for providing dimming control in which only a pair of wires are required.

In this arrangement a dimmer control is provided in the power supply line before the electronic ballast. This dimmer clips off part of the trailing or leading edge of the power supply curve so as to reduce the average power supply to the lamp. In this way the dimming control operates in a way common to the dimming control provided to incandescent lamps. However, since this means that the average voltage applied also falls, this patent does not overcome the problem of the average voltage falling so low that the lamp fails to discharge.

Some of the problems that prior art proposals have faced include factors such as: (1) stable control of the light may be difficult to obtain, eg changing the supply voltage for control makes the lamp susceptible to power line fluctuations, (2) the proposed method may not be practicable due to cost constraints, this is true for example of variable inductance winding proposals, and (3) the control scheme may require a separate pair of control wires to be connected from the dimming unit to the ballast.

There remains a need for a simple and reliable means for providing dimming control for a fluorescent lamp and which overcomes or at least mitigates many of the aforesaid problems.

SUMMARY OF THE INVENTION

According to the present invention there is provided dimming control means for a fluorescent lamp comprising, means for removing a part of the phase of an applied input voltage, an electronic ballast means for driving the fluorescent lamp, and means for varying the switching frequency of said electronic ballast means in response to the phase removed.

By means of this arrangement while part of the phase is removed from the input supply voltage to control the dimming, this control is not performed directly from the reduced supply voltage, but rather information of the amount of phase removed is used to control the switching frequency of the ballast which in turn controls the light power output. This means that only a very small part of the phase of the input supply need be removed (say up to 15%) and the supply voltage does not fall below that required for the lamp to illuminate. Indeed the dimming control means may be provided with means for limiting the amount of phase that can be removed to ensure that this does not happen.

Preferably the dimming control means comprises (a) means for generating pulses of a width dependent on the amount of phase removed from the input supply voltage, (b) means for integrating the pulses to generate a voltage dependent on the pulse width, and (c) means for generating a switching signal for driving the ballast means, the switching signal having a switching frequency dependent on the voltage.

The integrating means may generate a peak voltage which is preferably then filtered by a lowpass filter to produce a filtered voltage.

The switching signal generating means may comprise means for converting the filtered voltage to a current varying at a frequency dependent on the voltage.

The pulse generating means may comprise a comparator for comparing the part phase removed applied input voltage to a reference voltage.

Preferably the dimming control may be either an open loop control or a closed loop control, for example in the latter case the lamp current may be sensed and provided as a feedback to the switching signal generating means.

Viewed from a further aspect the invention provides dimming control means for a fluorescent lamp including an electronic ballast, comprising: (a) means for removing part of the phase of an applied input supply voltage, (b) comparator means for generating pulses of a width dependent on the amount of phase removed from the input supply voltage, (c) means for integrating the pulses to generate a peak voltage dependent on the pulse width, (d) lowpass filter means for filtering said peak voltage, (e) means for converting the filtered voltage to a current varying at a frequency dependent on the voltage, and (f) means for generating a switching signal from the varying current for driving the ballast.

Viewed from a still further broad aspect the present invention provides a fluorescent lamp comprising, a gas discharge tube, an electronic ballast for driving the discharge tube, and means for providing dimming control of the lamp, wherein the dimming control means comprises means for removing part of the phase of an applied input supply voltage, and means for varying a switching frequency of the electronic ballast in response to the phase removed.

Viewed from yet another broad aspect the present invention provides a method for providing dimming control of a fluorescent lamp, comprising removing part of the phase of an applied input supply voltage, and varying a switching frequency of an electronic ballast in response to the amount of phase removed.

BRIEF DESCRIPTION OF DRAWINGS

An embodiment of the invention will now be described by way of example and with reference to the accompanying drawings, in which.

DETAILED DESCRIPTION OF PREFERRED EMBODIMENT

Figure 1:
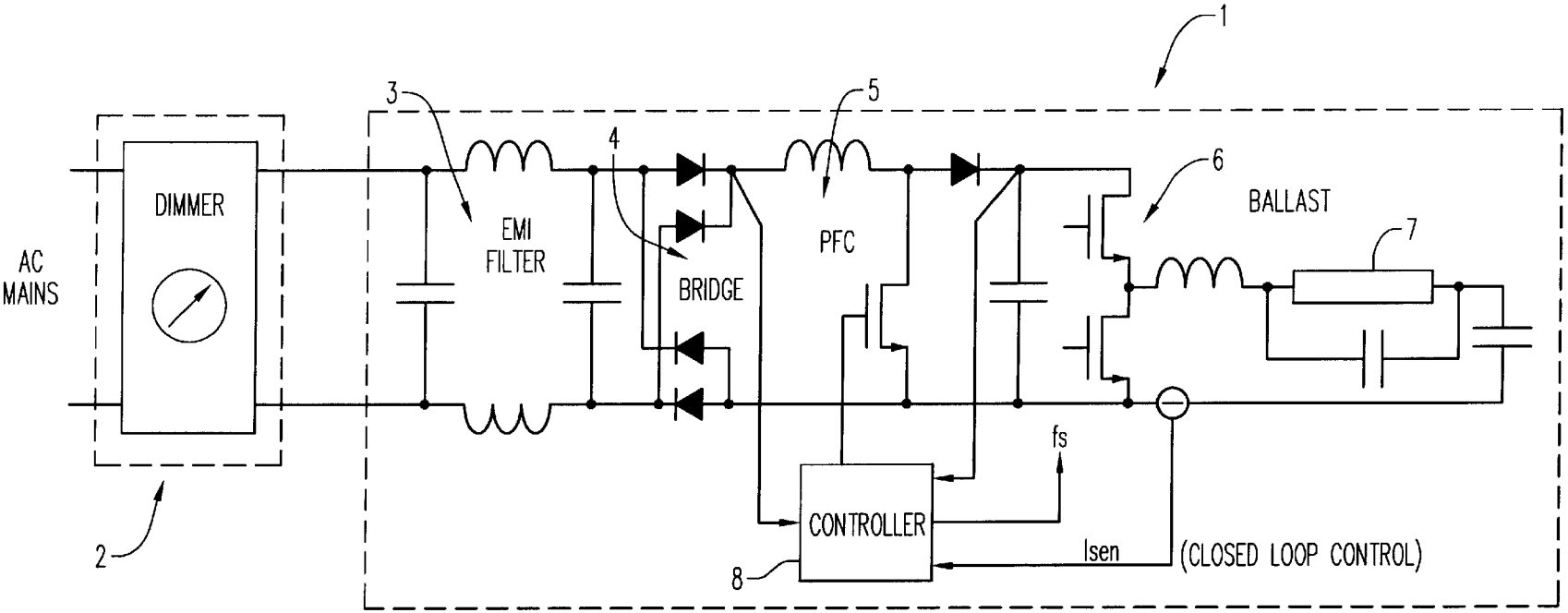
FIG. 1 is a circuit diagram of an embodiment of the present invention.

Referring firstly to FIG. 1 there is shown a first embodiment of the invention. A dimmable fluorescent lamp comprises a lamp unit 1 and a dimmer unit 2. The dimmer unit 2 is located between the AC mains and the lamp unit 1, and a separate pair of control wires for the dimmer is not required. The dimmer unit 2 may therefore be located together with an on/off switch—or the on/off switch may be formed as part of the dimmer unit—and no separate wring is necessary for the dimmer unit 2. The dimmer control may be provided in the power supply in series (FIG. 2(*a*)) or in parallel (FIG. 2(*b*)).

The lamp unit 1 comprises a number of conventional elements, including an EMI filter means 3, a rectifying bridge means 4 for converting the input AC voltage to a DC voltage, a power factor correction (PFC) circuit 5, a ballast comprising a Class D inverter 6 with a resonant circuit for driving the discharge lamp 7. The lamp unit 1 also comprises a controller 8 for controlling the switching frequency of the inverter 6 in a manner to be described below. The filter means 3, rectifying bridge 4, and PFC circuit 5 may all be conventional. For example, the PFC circuit 5 may be either an active or passive circuit. In experimental tests an active boost converter PFC MC33262 from Motorola has been used together with a half-bridge driver HIP2500 from Harris Semiconductor.

Figure 2A:
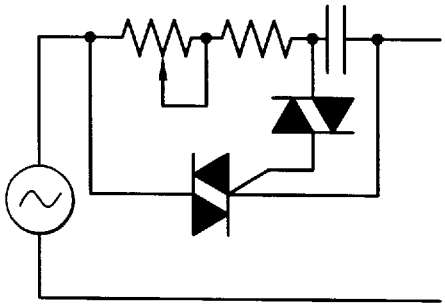
FIGS. 2(*a*) & (*b*) illustrate series and parallel forms of the dimmer control.
Figure 2B:
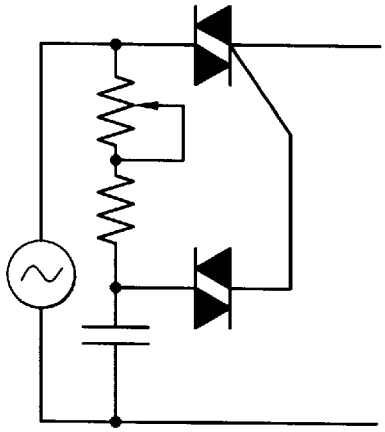
Figure 3:
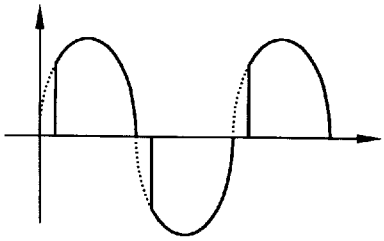
FIG. 3 illustrates the phase removal.

As shown in FIGS. 2(*a*) & (*b*) the dimmer unit 2 may be connected in series (FIG. 2(*a*)) or in parallel (FIG. 2(*b*)). The dimmer unit 2 comprises a dimmer unit of the form that is used in conventional dimming control of incandescent lamps and operates by removing a small portion of the phase of the AC power supply as shown in FIG. 3. The dimmer unit 2 is modified, however, such that only a small portion of the phase can be removed, preferably no more than about 15° so that the average voltage cannot fall below that required to strike the discharge lamp and a reasonably high power factor is obtained.

Figure 4:
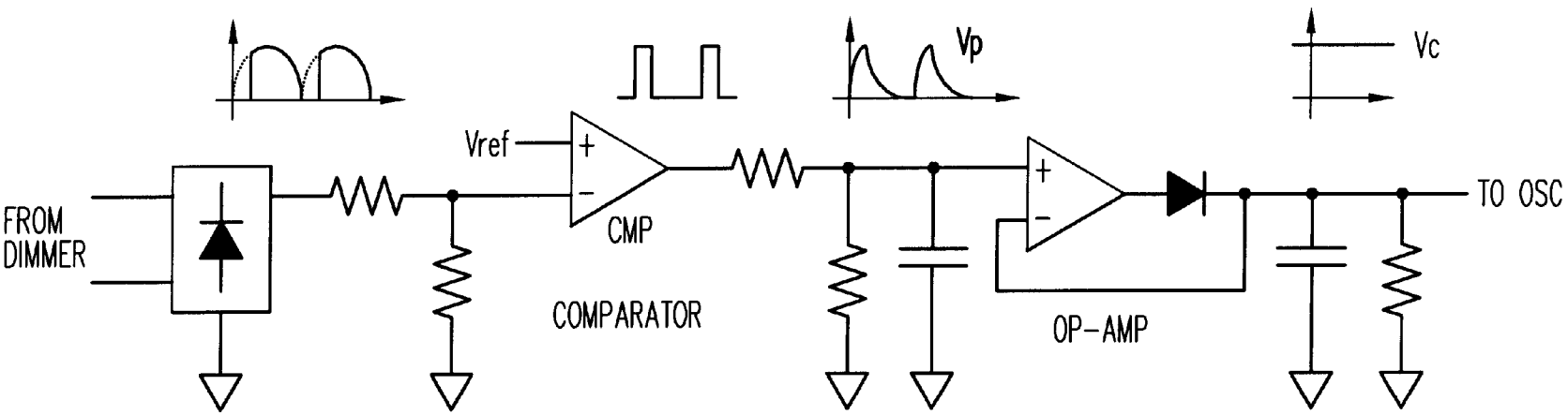
FIG. 4 illustrates means for detecting the phase removed.

The controller 8 comprises means for detecting the phase removed from the input power supply, and means for varying the switching frequency of the ballast in response to the amount of phase removed as will now be described with reference to FIGS. 4 & 5. The mains AC supply is partially clipped by the dimmer unit 2 such that a small portion (preferably less than 15° ) of the phase is removed as is shown in FIG. 3. This AC supply is then rectified by the diode bridge as shown in the voltage plots forming the top part of FIG. 4.

The phase removed and rectified supply voltage is then input to a comparator for comparison with a reference voltage $V_{ref}$ so as to perform a phase to pulse conversion in which pulses are generated where the pulse width is proportional to the amount of phase removed by the dimmer unit 2. A resistor string senses the rectified and truncated sine wave and the output is fed to a comparator CMP. The output of the comparator CMP is then a rectangular pulse with a duty ratio determined by the removed phase.

Figure 6A:
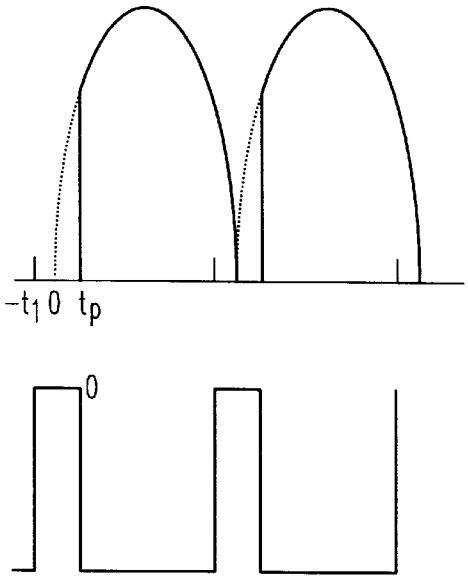
Figure 6B:
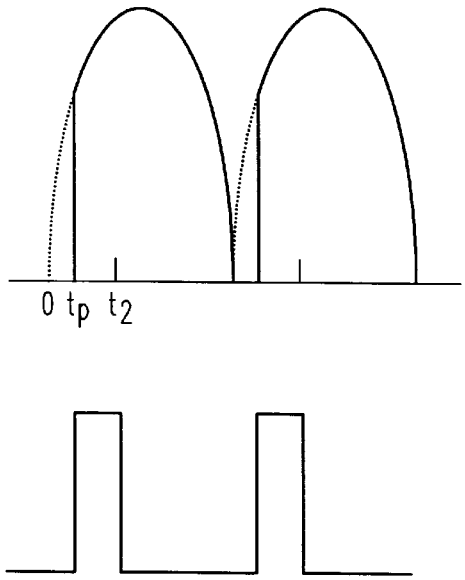

FIGS. 6(*a*) and (*b*) illustrate two alternative methods of generating pulses from a chopped power line where the part of the cycle from 0 to $t_p$ has been removed. In FIG. 6(*a*) a pulse starts at a time $-t_1$ and has a length $t_1+t_p$ (it being noted here that ti may be zero). Alternatively, as shown in FIG. 6(*b*) the pulse may start at $t_p$ and then end at a later time $t_2$ such that the duration of the pulse is $t_2-t_p$.

The pulses generated by the comparator are then fed to an integrating circuit and the peak voltage $V_P$ of the integrated voltage is approximately proportional to the removed phase. The peak voltage $V_P$ is recorded by an op-amp peak detector and passed through a lowpass filter to give a filtered voltage $V_C$.

Figure 5:
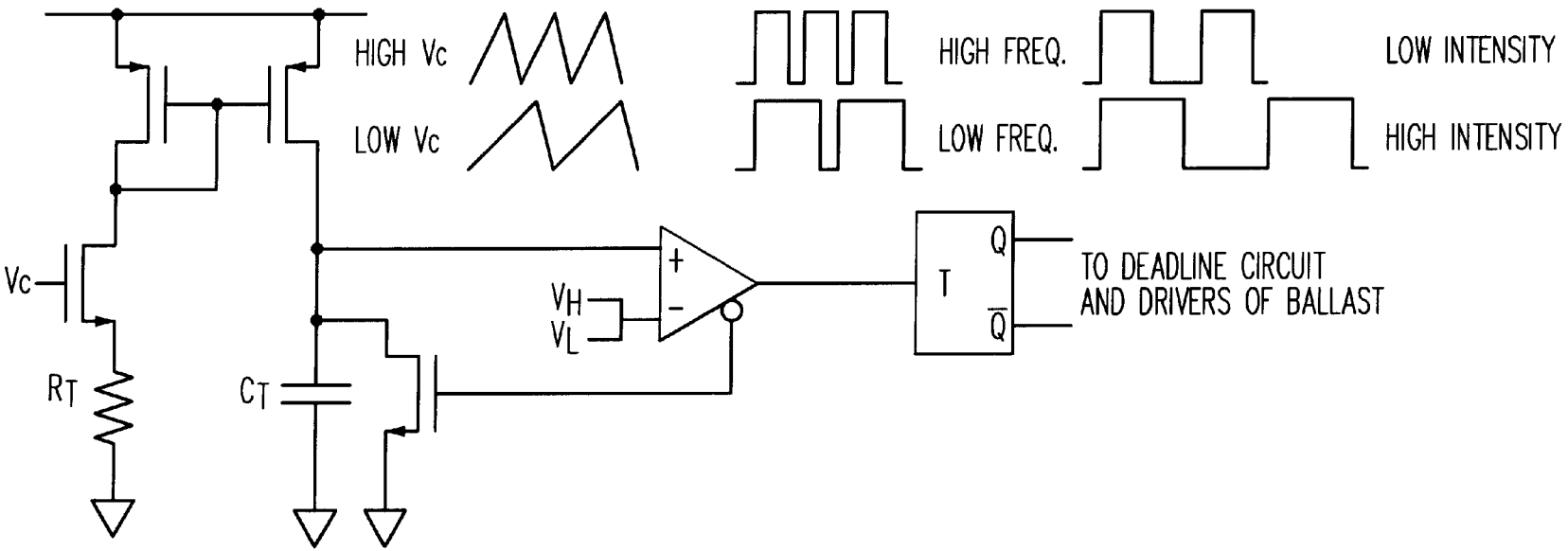
FIG. 5 illustrates means for generating a switching frequency in response to the phase removed, and FIGS. 6(*a*) and (*b*) illustrate two alternative methods of pulse generation in response to removed phase.

One possible implementation of the oscillator means is shown in FIG. 5, where the filtered voltage $V_C$ is used to control the switching frequency of the ballast. Fiitered voltage $V_C$ is fed to an oscillator so as to control the current flowing through $R_T$ which is mirrored so as to charge $C_T$ . A higher $V_C$ means a higher charging rate and in turn a higher oscillation frequency. The sawtooth charge and discharge cycle of capacitor $C_T$ is converted to a sequence of square pulses by means of a hysteretic comparator which are then output to drive the switches of the ballast, and as is conventional a high switching frequency results in low power output.

Thus in order to vary the light power output of the fluorescent lamp and dimmer unit 2 is used as follows. If the dimmer unit 2 is operated so as to remove a greater portion of the phase of the input AC supply, this results in a phase to pulse conversion giving pulses of relatively large width and when these pulses are passed to the integrator they result in a large peak voltage $V_P$ and a large filtered voltage $V_C$. A large filtered voltage when passed to the oscillator causes a high charging rate and a high frequency of output pulses to drive the ballast switches and thus a low light power output from the lamp. Conversely if the dimmer unit 2 is set to remove a relatively smaller part of the phase of the AC supply, that results in pulses of a smaller width, a lower peak voltage and a lower filtered voltage, lower charging rate in the oscillator and hence lower switching frequency and higher output light power.

It is important to note here that the power output of the fluorescent lamp can be controlled over a range from 100% (at a switching frequency of 30 kHz and 7° phase removed) to 5% (at a switching frequency of 60 kHz and 15° phase removed) while only removing up to 15% of the phase from the mains supply voltage and thus not causing the average supply voltage to fall below that necessary to cause the lamp to discharge. It will of course be understood that these particular values are approximate only and some variation may be possible.

The switching frequency of the lamp may be controlled either by an open loop control in which the filtered voltage simply controls the switching frequency through the charging rate of $C_T$, or alternatively and as shown in FIG. 1 the switching frequency may be effected by closed loop control in which the lamp current is sensed ($I_{sen}$) and this current is fed back to the controller 8 to the comparator.

What is claimed is:

1. A fluorescent lamp comprising, a gas discharge tube, electronic ballast means for driving said discharge tube, and means for providing dimming control of said lamp, wherein said dimming control means comprises:

(a) means for removing part of the phase of an applied input supply voltage, (b) comparator means for generating pulses of a width dependent on the amount of phase removed from the input supply voltage, (c) means for integrating said pulses to generate a peak voltage dependent on the pulse width, (d) lowpass filter means for filtering said peak voltage, (e) means for converting said filtered voltage to a current varying at a frequency dependent on said voltage, and (f) means for generating a switching signal from said varying current for driving said ballast.

2. Dimming control means for a fluorescent lamp comprising, means for removing part of the phase of an applied input supply voltage, an electronic ballast means for driving the fluorescent lamp, and means for varying a switching frequency of said electronic ballast means in response to the phase removed, wherein said means for varying said switching frequency comprises:

(a) means for generating pulses of a width dependent on the amount of phase removed from the input supply voltage, (b) means for integrating said pulses to generate a voltage dependent on the pulse width, and (c) means for generating a switching signal for driving said ballast means, said switching signal having a switching frequency dependent on said voltage.

3. Dimming control means as claimed in claim 2 wherein said integrating means generates a peak voltage, and lowpass filter means are provided to produce a filtered voltage.

4. Dimming control means as claimed in claim 2 wherein said switching signal generating means comprises means for converting said voltage to a current varying at a frequency dependent on said voltage.

5. Dimming control means as claimed in claim 2 wherein said pulse generating means comprises a comparator for comparing the part phase removed applied input voltage with a reference voltage.

6. Dimming control means as claimed in claim 2 wherein said means for generating a switching signal is subject to closed loop control by means of detecting the lamp current.

7. Dimming control means as claimed in claim 2 wherein means are provided for limiting the amount of phase that can be removed from the input supply voltage.

8. Dimming control means as claimed in claim 7, wherein the amount of phase that can be removed is limited to no more than about 15°.

9. Dimming control means for a fluorescent lamp including an electronic ballast, comprising:

(a) means for removing part of the phase of an applied input supply voltage, (b) comparator means for generating pulses of a width dependent on the amount of phase removed from the input supply voltage, (c) means for integrating said pulses to generate a peak voltage dependent on the pulse width, (d) lowpass filter means for filtering said peak voltage, (e) means for converting said filtered voltage to a current varying at a frequency dependent on said voltage, and (f) means for generating a switching signal from said varying current for driving said ballast.

10. A fluorescent lamp comprising, a gas discharge tube, an electronic ballast for driving said discharge tube, and means for providing dimming control of said lamp, wherein said dimming control means comprises means for removing part of the phase of an applied input supply voltage, and means for varying a switching frequency of said electronic ballast in response to the phase removed, wherein said means for varying said switching frequency comprises:

(a) means for generating pulses of a width dependent on the amount of phase removed from the input supply voltage, (b) means for integrating said pulses to generate a voltage dependent on the pulse width, and (c) means for generating a switching signal for driving said ballast, said switching signal having a switching frequency dependent on said voltage.

11. A fluorescent lamp as claimed in claim 10 wherein said integrating means generates a peak voltage, and lowpass filter means are provided to produce a filtered voltage.

12. A fluorescent lamp as claimed in claim 10 wherein said switching signal generating means comprises means for converting said voltage to a current varying at a frequency dependent on said voltage.

13. A fluorescent lamp as claimed in claim 10 wherein said pulse generating means comprises a comparator for comparing the part phase removed applied input voltage with a reference voltage.

14. A fluorescent lamp as claimed in claim 10 wherein said means for generating a switching signal is subject to closed loop control by means of detecting the lamp current.

15. A fluorescent lamp as claimed in claim 10 wherein means are provided for limiting the amount of phase that can be removed from the input supply voltage.

16. A fluorescent lamp as claimed in claim 15 wherein the amount of phase that can be removed is limited to no more than about 15°.

17. A method for providing dimming control of a fluorescent lamp, comprising removing part of the phase of an applied input supply voltage, and varying a switching frequency of an electronic ballast in response to the amount of phase removed, wherein said switching frequency is varied by:

(a) generating pulses of a width dependent on the amount of phase removed from the input supply voltage, (b) integrating said pulses to generate a voltage dependent on the pulse width, and (c) generating a switching signal for driving the ballast, said switching signal having a switching frequency dependent on said voltage.

18. A method as claimed in claim 17 wherein said pulses are integrated to generate a peak voltage, and wherein said peak voltage is passed through a lowpass filter.

19. A method as claimed in claim 17 wherein said switching signal is generated by converting said voltage to a current varying at a frequency dependent on said voltage.

20. A method as claimed in claim 17 wherein said pulses are generated by means of a comparator that compares the part phase removed applied input supply voltage with a reference voltage.

21. A method as claimed in claim 17 wherein the generating of said switching signal is subject to closed loop control by means of the detected lamp current.

* * * * *